US005649627A

United States Patent [19]

Wako

[11] Patent Number: 5,649,627

[45] Date of Patent: Jul. 22, 1997

[54] PAPER PROCESSING APPARATUS FOR SORTING AND SHREDDING PAPERS

[75] Inventor: Jiro Wako, Yokohama, Japan

[73] Assignee: Kabushiki Kaisha Toshiba, Kawasaki, Japan

[21] Appl. No.: 362,975

[22] Filed: Dec. 23, 1994

[30] Foreign Application Priority Data

Dec. 24, 1993 [JP] Japan ..... 5-327805

[51] Int. Cl.[6] ..... B07C 5/00

[52] U.S. Cl. ..... 209/534; 53/54; 53/498; 241/33

[58] Field of Search ..... 209/534, 552, 209/583; 53/54, 498, 500; 83/62.1; 241/33–34, 236

[56] References Cited

U.S. PATENT DOCUMENTS 4,166,030 8/1979 Lewis et al. ..... 209/534

4,376,364 3/1983 Horino et al. ..... 209/534 X

*Primary Examiner*—Boris Milef

*Attorney, Agent, or Firm*—Cushman Darby & Cushman, IP Group of Pillsbury Madison & Sutro, LLP

[57] ABSTRACT

A paper processing apparatus including a paper supplier for supplying papers one by one. A checker reads the papers supplied by the paper supplier to check at least whether the papers are complete or dirty papers. A transferrer transfers the papers checked by the checker. A collector collects papers checked as complete papers by the checker from among the papers transferred by the transferrer. A brancher branches papers checked as dirty papers by the checker from among the papers transferred by the transferrer. A discarder discards dirty papers branched by the brancher. A detector detects an abnormality of the transferrer and the discarder. A controller controls the brancher before the checker determines the checking result such that dirty papers are collected in the collector when an abnormality is detected in at least either the transferrer or the discarder by the detector.

8 Claims, 7 Drawing Sheets

PAPER PROCESSING APPARATUS FOR SORTING AND SHREDDING PAPERS

BACKGROUND OF THE INVENTION

1. Field of the Invention

The present invention relates to a paper processing apparatus, which can sort papers into papers to be cut, e.g., dirty securities, which are not suitable for use in the market, and complete papers (securities). The invention can process papers to be cut as required.

2. Description of the Related Art

A paper processing apparatus with a cutting function, which can sort papers, e.g., securities used in the market into complete securities and dirty securities, and which can cut securities to a predetermined size, has been put to practical use recently.

This type of paper processing apparatus has a checking section for checking the condition, e.g., dirt, of the securities transferred from a supply section one by one, a complete paper holding section for holding the securities checked as complete papers by the checking section, and a cutting section for cutting the securities checked as papers to be cut to size less than a predetermined size by the checking section.

The securities set in the supply section are picked up one by one by a pick-up mechanism, and transferred in a transfer path. The possible conditions of the securities, which are being transferred in the transfer path are checked one by one by the checking section, which is provided in the middle of the transfer path. The conditions include complete condition, dirty condition, different kind of papers and impossible to check.

The securities checked by the checking section are sorted into dirty papers, complete papers, and unusable papers such as different kinds of papers and papers which cannot be checked. Then, the complete papers and unusable papers are guided to a complete paper holding section and an unusable paper holding section.

On the other hand, dirty papers are transferred to a cutting section to be cut to a size less than a predetermined size by a cutting device.

In the above cutting device, if an abnormality occurs, many dirty papers are passed through the transfer path from the time the abnormality is detected until the main body of the apparatus is completely stopped. The blade of the cutting device can become damaged and the number of dirty papers actually cut by the cutting device does not conform to the count of the number of dirty papers to be discarded.

Moreover, there is a problem wherein various kinds of papers become mixed, and sorted papers being transferred are jammed in the cutting device or the transfer path directing papers to the cutting device. There is also a problem wherein identification data for each paper being transferred and the order of papers being transferred does not correspond. Moreover, there is a problem in which papers other than dirty papers are erroneously guided to the cutting device.

In order to prevent paper other than dirty paper from being cut, a paper processing apparatus is proposed which incorporates a retreat mechanism and a retreat gate into the transfer path before the entrance to the cutting device.

According to this type of paper processing apparatus, when an abnormality occurs in the cutting device, papers other than dirty papers are guided to the retreat gate, so that these papers can be prevented from being directed to the cutting device.

However, the use of this type of retreat mechanism is unnecessary in normal processing making the processing apparatus complicated and enlarged. Moreover, the manufacturing cost of the paper processing apparatus is increased.

SUMMARY OF THE INVENTION

An object of the present invention is to provide a paper processing apparatus, which, when an abnormality occurs, can easily be restored to a processing state and can reduce damage to the processing apparatus.

Another object of the present invention is to provide a paper processing apparatus in which papers other than dirty papers are not erroneously cut.

Moreover, another object of the present invention is to provide a paper processing apparatus in which papers guided to a cutting device can be withdrawn.

According to a first aspect of the present invention, there is provided a paper processing apparatus comprising: supplying means for supplying papers one by one; checking means for reading the papers supplied by the supplying means to at least check whether the papers are complete paper or dirty papers; transferring means for transferring the papers checked by the checking means; collecting means for collecting papers checked as complete papers by the checking means from among the papers transferred by the transferring means; branching means for branching papers checked as dirty papers by the checking means from among the papers transferred by the transferring means; discarding means for discarding dirty papers branched by the branching means; detecting means for detecting an abnormality of the transferring means and the discarding means; and controlling means for controlling the branching means before the checking means determines the checking result such that dirty papers are collected in the collecting means when the detecting means detects an abnormality in at least either the transferring means or the discarding means.

According to a second aspect of the present invention, there is provided a paper processing apparatus comprising: supplying means for supplying papers one by one; first transferring means for transferring the papers supplied by the supplying means; checking means for reading the papers supplied by the first transferring means to at least check whether the papers are complete paper or dirty papers; second transferring means for transferring the papers checked by the checking means; collecting means for collecting papers checked as complete papers by the checking means from among the papers transferred by the second transferring means; branching means for branching papers checked as dirty papers by the checking means from among the papers transferred by the second transferring means, third transferring means for transferring the papers branched by the branching means; and discarding means for discarding the papers branched by the third transferring means.

According to a third aspect of the present invention, there is provided a paper processing apparatus comprising: supplying means for supplying papers one by one; first transferring means for transferring the papers supplied by the supplying means; checking means for reading the papers supplied by the first transferring means to at least check whether the papers are complete paper or dirty papers; second transferring means for transferring the papers checked by the checking means; collecting means for collecting papers checked as complete papers by the checking means from among the papers transferred by the second transferring means; branching means for branching papers checked as dirty papers by the checking means from among the papers transferred by the second transferring means; first controlling means for controlling the branching means to branch the papers checked as dirty papers by the checking means from among the papers transferred by the second transferring means; third transferring means for transferring the papers branched by the branching means; discarding means for discarding the papers branched by the third transferring means; detecting means for detecting an abnormality of the first to third transferring means and that of the discarding means; and second controlling means for controlling the branching means prior to the checking means such that dirty papers are collected in the collecting means when an abnormality is detected in at least one of the first to third transferring means and the discarding means by the detecting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
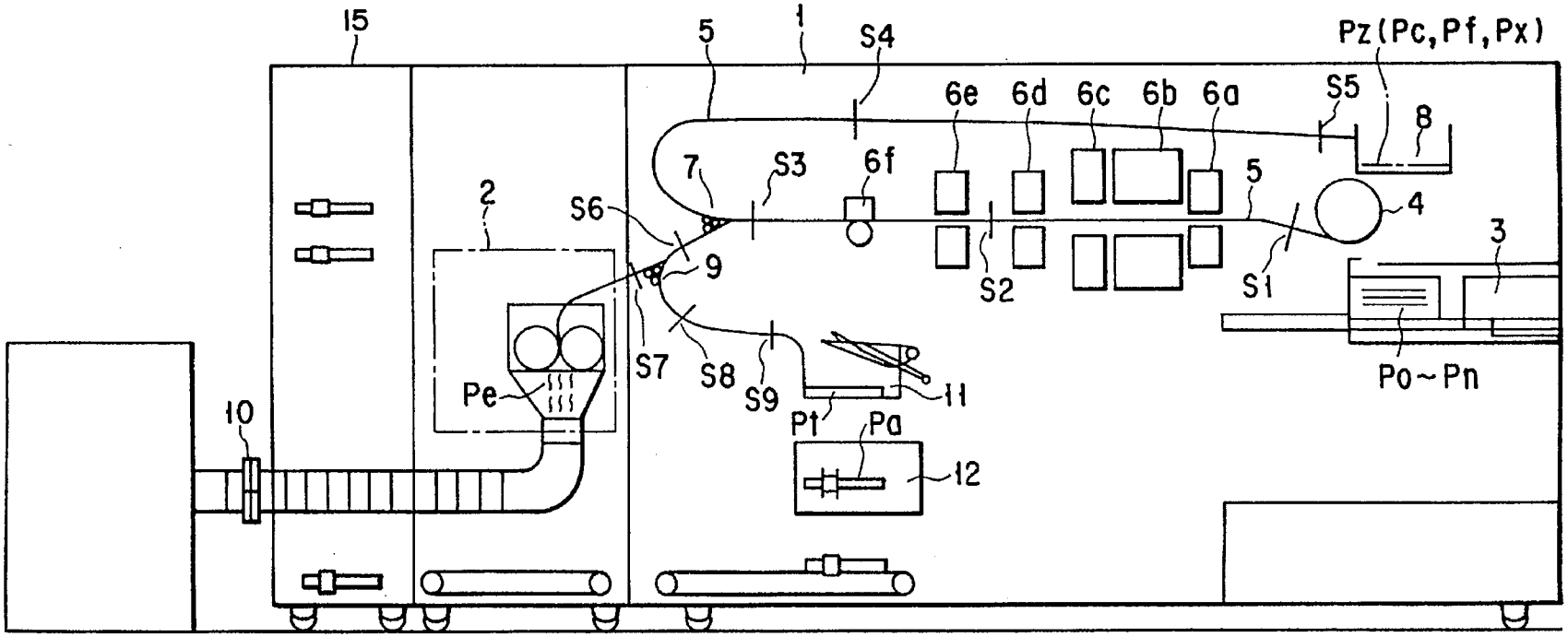
FIG. 1 is a schematic cross sectional view of a paper processing apparatus in which an embodiment of the present invention is incorporated.

FIG. 1 shows an outline of an apparatus of a first embodiment of the present invention for processing papers, for example, securities.

The apparatus for processing securities has a main body 1 of a security processing section and a shredding unit or cutting device 2, which is incorporated into the main body 1.

According to the main body 1 of the security processing section, securities (papers) Po, . . . Pn set in a supplying section 3 are transferred to a transfer path 5 from a pick-up roller 4 one by one in order.

The various elements of the securities Po, . . . Pn (hereinafter typically shown as Pn–x) such as size, suitability (breakage), description(s) (character(s)), position of the description, color, property of ink, or specific identification code, etc., which are transferred to the transfer path 5, are detected by the first through sixth detectors *6a* to *6f* arranged along the transfer path 5. Based on the detection results of the first through sixth detectors, the securities Pn–x are checked by the check section, to be described later, to determine whether the securities Pn–x are complete papers Pt (next marketable papers), dirty papers Pe to be shredded due to dirt, etc., or unusable papers Pz, which are neither complete nor dirty papers, (for example, different kinds of papers Pi, defective papers Pf, or holding papers Ph, which cannot be checked and which need to be detected again or visually confirmed by a clerk).

The identification codes correspond to the transferring order, that is, a complete paper signal SPt indicating complete papers, a dirty paper signal Spe indicating dirty papers, and an unusable paper signal SPz indicating unusable papers is associated with the securities Pn–x transferred to the transfer path 5 by a main controller, to be described later. Also, such a signal is temporarily stored in a memory (not shown) to correspond to the transferring order.

Based on the detection results of the first through sixth detectors, securities Pn–x are checked by the check section to determine whether securities Pn–x are complete papers Pt, dirty papers Pe, or unusable papers Pz and are further transferred by the transfer path 5 according to the identification code, and guided to one of the unusable paper collecting section, the cutting device, and the complete collecting section, which are described later, in accordance with a change of the respective sorting gates.

More specifically, the securities Pn–x transferred to the transfer path 5 are separated into complete papers Pt, dirty papers Pe, and unusable papers Pz by the operation of an unusable paper sorting gate 7. The unusable papers Pz separated by the unusable paper sorting gate 7 are collected in the unusable paper collecting section 8. Before the first through sixth detecting sections *6a* to *6f* determine the detection results, the unusable paper sorting gate 7 is formed such that all papers are guided to the unusable paper collecting section 8 (that is, when no control is provided from the outer unit).

The unusable paper sorting gate 7 has first and second solenoids to be described later. The unusable paper sorting gate 7 is formed to provide two states, a securities Pn–x passing state in which securities Pn–x are guided to the cutting device 2 or the complete paper collecting section 11, and a securities Pn–x changing (branching) state in which securities Pn–x are guided to the unusable paper collecting section 8. A passing state gate driving signal GDzs, which is supplied from the transferring sort controlling section, to be described later, is inputted. Whereby, the first solenoid changes the unusable paper sorting gate 7 to the passing state, so that the securities Pn–x to be passed through the unusable paper sorting gate 7 are guided to the cutting device or the complete paper collecting section. A branching state gate driving signal GDzt, which is supplied from the transferring sort controlling section, to be described later, is inputted. Whereby, the second solenoid changes the unusable paper sorting gate 7 to the branching state, so that the securities Pn–x to be passed through the unusable paper sorting gate 7 are guided to the unusable paper collecting section 8.

The securities Pn–x, that is, non-unusable papers, which are guided to the cutting device or the complete paper collecting section (passing state), are further transferred by the transfer path 5, and separated into complete papers Pt and dirty papers Pe by the operation of a dirty paper sorting gate 9 based on the identification results stored in the memory (not shown), that is, identification code Pe or Pt provided to correspond to the transferring order. Before the first through sixth detecting sections 6*a* to 6*f* determine the detection results, the dirty paper sorting gate 9 is formed such that all papers are guided to the complete paper collecting section 11 when the paper processing apparatus is non-operational or in an abnormal operational state (that is, when no control is provided from the outer unit).

The dirty paper sorting gate 9 has third and fourth solenoids, to be described later. The dirty paper sorting gate 9 is formed to provide two states. The first state is a securities Pn–x passing state in which securities Pn–x are guided to the complete paper collecting section 11. A passing state gate driving signal GDes, which is supplied from the transferring sort controlling section, to be described later, is inputted. Whereby, the third solenoid changes the dirty paper sorting gate 9 to the passing state, so that the securities Pn–x to be passed through the dirty paper sorting gate 9 are guided to the complete paper collecting section. A branching state gate driving signal GDet, which is supplied from the transferring sort controlling section, is inputted. Whereby, the fourth solenoid changes the dirty paper sorting gate 9 to the second state or branching state, so that the securities Pn–x to be passed through the dirty paper sorting gate 9 are guided to the cutting device 2.

The dirty papers Pe passed through the dirty paper sorting gate 9, which is changed to be in the branching state, are further transferred by the transfer path 5, and guided to the cutting device 2. The dirty papers Pe guided to the cutting device 2 are cut to have a size, which is less than a predetermined size, by the cutting device 2, discharged to the outer section of the main body 1 by cut piece discharging path 10, and contained in a cut piece collecting chamber (no reference numeral). The dirty papers Pe may be passed the dirty paper sorting gate 9 in accordance with the instruction from the control panel (not shown) to be collected in the dirty paper collecting section. On the other hand, the complete papers Pt passed through the dirty paper sorting gate 9, which is defined to be in the passing state, are further transferred by the transfer path 5. Then, the complete papers Pt are transferred to a complete paper collecting section 11.

The complete papers collected in the complete paper collecting section 11 are guided to a complete paper bundle section 12 every predetermined number of complete papers through a counter (not shown), which is provided at a predetermined position of the complete paper collecting section 11, whereby the complete papers are bundled every predetermined number of papers.

The bundle BPa of complete papers bundled by the complete paper bundle section 12 is collected in a bundle collecting section 15.

At a predetermined position of the transfer path 5 of the main body 1, there are provided a plurality of shift sensors S1 to S9 to detect the flow of the securities Pn–x, which are guided from the supply section 3 to the cutting device 2, the unusable paper collecting section 8 and the complete paper collecting section 11, or paper jam of the securities Pn–x in the transfer path 5. Needless to say, the state of the securities Pn–x transferred to the transfer path 5 of the main body 1 is checked by the controlling section, to be described later.

Figure 2:
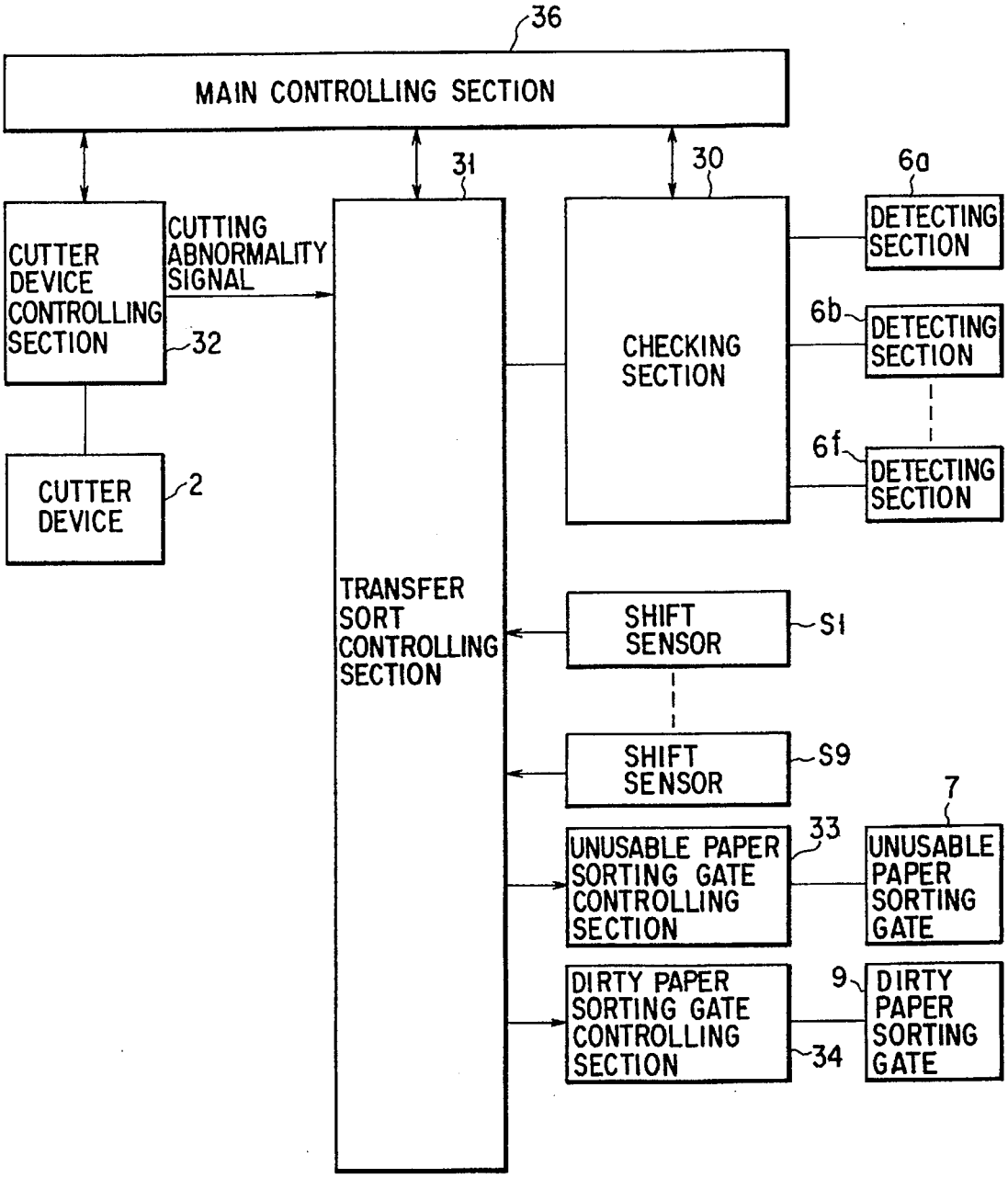
FIG. 2 is a schematic block diagram of the paper processing apparatus of FIG. 1.

FIG. 2 is a schematic block diagram showing the state of the electrical connection of the apparatus for processing the securities of FIG. 1.

With reference to FIG. 2, the detection result obtained by the first through sixth detectors 6*a* to 6*f*, which are arranged along the transfer path 5, is inputted to a checking section 30 in the order in which the securities Pn–x are transferred.

The checking section 30 classifies the securities Pn–x, which are being transferred in the transfer path 5 as complete papers Pt, dirty papers Pe, or unusable papers Pz based on the result obtained by the first through sixth detectors 6*a* to 6*f*. The checking results are temporarily stored in the memory (not shown) through the main controlling section 36, to be described later, as identification codes corresponding to the transfer order, that is, complete paper signal SPt, dirty paper signal SPe, and unusable paper signal SPz, and inputted to a transfer sort controlling section 31.

The position of the securities Pn–x transferred in the main body 1 by the transfer path 5 is checked by inputting a present signal Sp as passage confirming data outputted from each of the shift sensors S1 to S9 into the transfer sort controlling section 31. Since the securities Pn–x are transferred one by one in order, the main controlling section checks which papers correspond to the present signal Sp sent from each of the sensors S1 to S9.

A cutting device controlling section 32 is connected to the transfer sort controlling section 31. The cutting device controlling section 32 controls the drive/stop of the cutting device, and counts the number of papers cut by the cutting device 2.

The cutting device controlling section 32 monitors the load state (particularly, overload level) applied to the blade of the cutting unit of the cutting device 2 and abnormalities of the cutting device 2 such as a paper jam of securities Pn–x, which occurs just before the blade of the cutting device. If an overload or paper jam of securities Pn–x is detected, a cutting abnormality signal SHRe is outputted to the transfer sort controlling section 31.

Moreover, the unusable paper sorting gate 7 and the dirty paper sorting gate 9 are connected to the transfer sort controlling section 31 to be independently driven through an unusable paper sorting gate controlling section 33 and a dirty paper sorting gate controlling section 34, respectively.

The transfer sort controlling section 31 guides the securities Pn–x being transferred in the transfer path 5 to the unusable paper collecting section 8, the cutting device 2, or the complete paper collecting section 11 based on the present signals Sp sent from the shift sensors S1 to S9 provided at the predetermined position of the main body 1, and the identification codes. The identification codes are the unusable paper signal SPz, the dirty paper signal SPe, and the complete paper signal SPt corresponding to the transfer order stored in the memory (not shown) by the sorting of the checking section 30 based on the detection results of the first through sixth detecting sections 6*a* to 6*f*.

Moreover, if an abnormality occurs such as an overload of the blade of the cutter unit of the cutting device or a paper jam of securities Pn–x just before the blade of the cutter unit of the cutting device, the cutting device controlling section 32 generates a cutting device abnormal signal SHRe to the transfer sort controlling section 31 which outputs a sorting gate abnormality processing change signal Ge (gate driving signals CDzt and GDes are generically named). Before the first through sixth detecting sections 6*a* to 6*f* determine the detection results, the sorting gate abnormality processing change signal Ge is used to change the sorting gates 7 and 9 corresponding to the respective gate controlling sections to the predetermined sides such that the securities Pn–x being transferred in the transfer path 5 are not guided to the cutting device 2 through an unusable paper sorting gate controlling section 33 and a dirty paper sorting gate controlling section 34.

Regarding the sides (directions) to which the sorting gates 7 and 9 are changed by the sorting gate abnormality processing change signal Ge, the sorting gate 7 is defined as the changing (branching) side, and the sorting gate 9 is defined as the passing state sides.

The following will specifically explain the classification of the securities Pn–x transferred in the main body 1, the operation of each of the sorting gates 7 and 9 and the transferring direction (flow) of the securities Pn–x.

When the security (paper) Pn–x being transferred in the transfer path is unusable paper Pz, an unusable paper sorting gate drive timing signal GTz is outputted from the transfer sort controlling section 31 to the unusable paper sorting gate controlling section 33 at the time when the top end of the security Pn–x (Pz) is passed through the shift sensor S3. The unusable paper sorting gate drive timing signal GTz is outputted thereto so as to switch the unusable paper sorting gate 7 to the unusable paper collecting section 8 based on the identification code SPz corresponding to the transfer order read from the memory (not shown) through the main controlling section 36. The unusable paper sorting gate drive timing signal GTz is inputted to the unusable paper sorting gate controlling section 33. Whereby, an unusable paper sorting gate drive signal GDzt is supplied to the unusable paper sorting gate 7 by the unusable paper sorting gate controlling section 33, the unusable paper sorting gate 7 is switched to the unusable paper collecting section 8, and the transfer path 5 is changed to direct paper to the unusable paper collecting section 8. Needless to say, the unusable paper sorting gate controlling section 33 outputs the unusable paper sorting gate drive signal GDzt or GDzs based on the various signals supplied from the transfer sort controlling section 31 such as a transfer abnormality signal COVe (to be described later), the cutting abnormality signal SHRe, the unusable paper signal SPz, the dirty paper signal SPe, the complete paper signal SPt, and the unusable paper sorting gate drive timing signal GTz.

If the security paper Pn–x being transferred in the transfer path 5 is dirty paper Pe and cutting processing using the cutting device 2 is required from the control panel (not shown), the top end of the security Pn–x (Pe) is passed through the shift sensor S6, so that a dirty paper sorting gate drive timing signal GTe is outputted from the transfer sort controlling section 31 to the dirty paper sorting gate controlling section 34 to switch the dirty paper sorting gate 9 to direct paper toward the side of the cutting device 2. Based on the dirty paper sorting gate drive timing signal GTe, the dirty paper sorting gate drive signal GDet is supplied to the dirty paper sorting gate 9 by the dirty paper sorting gate controlling section 34. Whereby, the dirty paper sorting gate 9 is switched to direct paper toward the side of the cutting device 2, and the dirty papers Pe are transferred to the cutting device 2. The number of dirty papers Pe transferred to the cutting device 2 is correctly counted by the counter (not shown), cut to have a size which is less than the predetermined size, and discharged to the outer section of the main body 1 by the cut piece discharge path 10. The dirty paper sorting gate controlling section 34 outputs the dirty paper sorting gate drive signal GDes Dr GDet based on the various signals supplied from the transfer sort controlling section 31 such as the transfer abnormality signal COVe (to be described later), the cutting abnormality signal SHRe, the unusable paper signal SPz, the dirty paper signal SPe, the complete paper signal SPt, and the unusable paper sorting gate drive timing signal GTz.

Also, in a case where the security (paper) Pn–x being transferred is complete paper Pt, the unusable paper sorting gate 7 and the dirty paper sorting gate 9 are respectively switched to be the passing state, and the security Pn–x (Pt) is guided to the shift sensor S8. The above switch was performed by the control of the unusable paper sorting gate controlling section 33 and the dirty paper sorting gate controlling section 34 based on the identification code corresponding to the transfer order read from the memory (not shown) through the main controlling section 36.

When a paper jam of at least one of the securities Pn–x occurs in the transfer path 5, the transfer abnormality signal COVe, which indicates a paper jam in the transfer path 5, is outputted from one of any shift sensors S1 to S9 or the plurality of shift sensors. Whereby, each driving section of the transfer section 5 is stopped. However, each driving section cannot be stopped instantaneously. Due to this, when the transfer abnormality signal COVe is outputted, the transfer sort controlling section 31 outputs the sorting gate abnormality processing change signal Ge, which is used to switch each of the sorting gates 7 and 9 to the predetermined side, to the sorting gate controlling sections 33 and 34, which are used to drive the respective sorting gates. Whereby, gate driving signals GDzt and GDes, which are used to instruct the predetermined gate switching direction, are outputted to the corresponding sorting gates from the sorting gate controlling sections 33 and 34. As a result, the unusable paper sorting gate 7 is positioned to the branching state in which the transfer path 5 is on the side of the unusable paper collecting section 8, the sorting gate 9 is positioned to the passing state in which the transfer path 5 is on the side of the complete paper collecting section 11.

Before the first through sixth detecting sections 6*a* to 6*f* determine the detection results, even if the transfer path 5 of the main body 1 is stopped, only the complete papers Pt sorted by sorting gate 9 are collected in the complete paper collecting section 11. Also, dirty papers Pe, which are positioned in the transfer path 5 up to the sorting gate 7, unusable papers Pz, and securities Pn–x–1, Pn–x, Pn–x+1 of all complete papers Pt are collected in the unusable paper collecting section 8.

Therefore, in order to remove the securities Pn–x stopped in the middle of the transfer path 5 due to the cutting abnormality and restore processing, the securities Pn–x stopped in the middle of the transfer path 5 and the securities Pn–x collected in the unusable paper collecting section 8 can be prevented from being guided to the complete collecting section 11.

A second embodiment of the present invention will be described with reference to FIG. 3.

Figure 3:
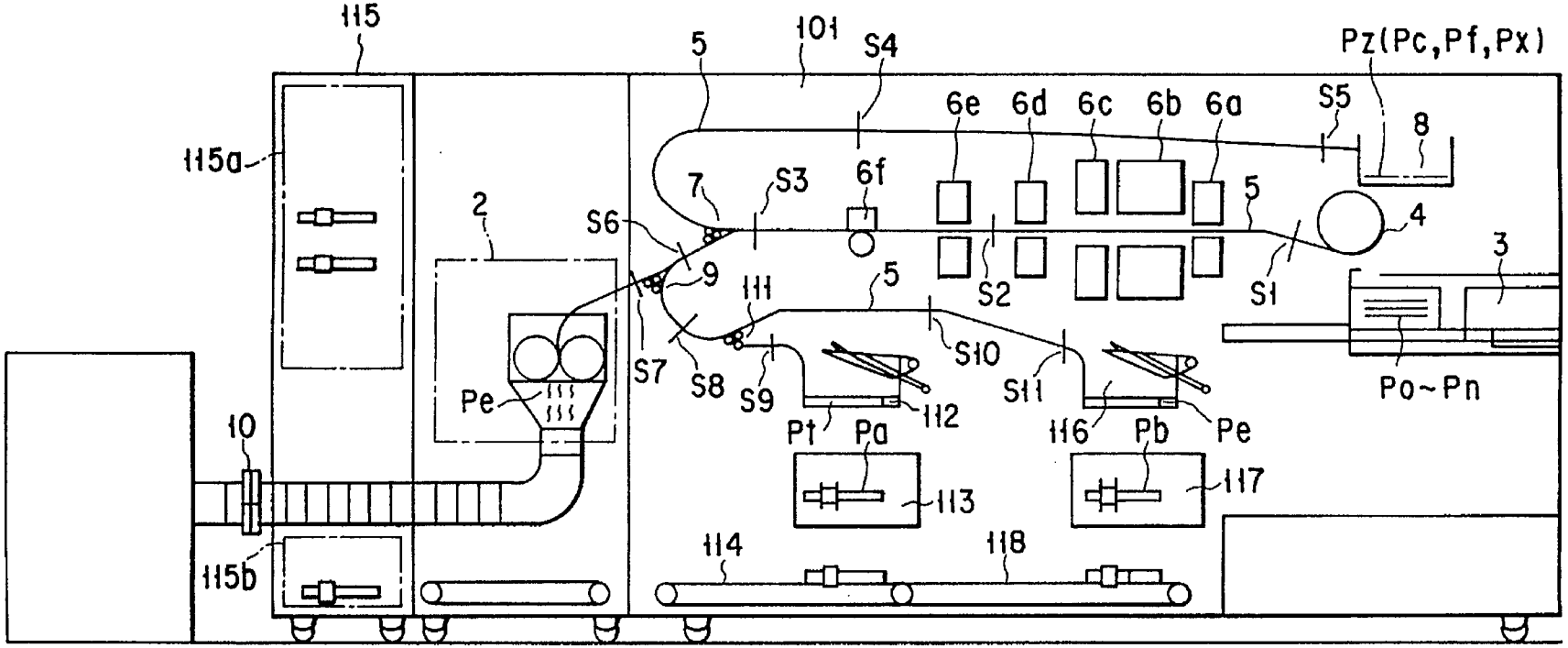
FIG. 3 is a schematic cross sectional view showing another embodiment of the paper processing apparatus of FIG. 1.

In FIG. 3, the same reference numerals are added to the same mechanism as the case of FIG. 1, and the specific explanation is omitted.

An apparatus for processing securities includes a main body 101 of a security processing section and a shredding unit 2, which is incorporated into the main body 101.

According to the main body 101 of the security processing section, securities (papers) Po, . . . Pn set in the supplying section 3 are transferred to the transfer path 5 from the pick-up roller 4 one by one in order.

The various elements of the securities Po, . . . Pn (hereinafter typically shown as Pn–x) such as size, suitability (breakage), description(s) (character(s)), position of the description, color, property of ink, or specific identification code, etc., which are transferred to the transfer path 5, are detected by the first through sixth detectors 6*a* to 6*f* arranged along the transfer path 5. Based on the detection results of the first through sixth detectors, the securities Pn–x are checked by the check section, to be described later to determine whether the securities Pn–x are complete papers Pt (next marketable papers), dirty papers Pe to be shredded due to dirt, etc., or unusable papers Pz, which are neither complete papers nor dirty papers, (for example, different kinds of papers Pi or holding papers Ph, which cannot be checked and which need to be detected again or visually confirmed by a clerk).

The identification codes correspond to the transferring order, that is, a complete paper signal SPt indicating complete papers, a dirty paper signal Spe indicating dirty papers, and an unusable paper signal SPz indicating unusable papers is associated with the securities Pn–x transferred to the transfer path 5 by a main controller, to be described later. Also, such a signal is temporarily stored in a memory (not shown) to correspond to the transferring order.

Based on the detection results of the first through sixth detectors, the securities Pn–x are checked by the check section to determine whether the securities Pn–x are complete papers Pt, dirty papers Pe, or unusable papers Pz and are further transferred by the transfer path 5 according to the identification code, and guided to one of the unusable paper collecting sections, the cutting device, and the complete collecting section, which are described later, in accordance with the change of the respective sorting gates.

More specifically, the securities Pn–x transferred to the transfer path 5 are separated into the complete papers Pt, dirty papers Pe, and unusable papers Pz by the operation of the unusable paper sorting gate 7. The unusable papers Pz separated by the unusable paper sorting gate 7 are collected in the unusable paper collecting section 8. Before the first through sixth detecting sections 6*a* to 6*f* determine the detection results, the unusable paper sorting gate 7 is formed such that all papers are guided to the unusable paper collecting section 8 or the dirty paper collecting section, to be described later, when the paper processing apparatus is non-operational or in an abnormal operational state (that is, when no control is provided from the outer unit).

The unusable paper sorting gate 7 has first and second solenoids, to be described later. The unusable paper sorting gate 7 is formed to provide two states, a securities Pn–x passing state in which securities Pn–x are guided to the cutting device or the complete paper collecting section, and a securities Pn–x changing (branching) state in which securities Pn–x are guided to the unusable paper collecting section 8. A passing state gate driving signal GDzs, which is supplied from the transferring sort controlling section 131, to be described later, is inputted, whereby the first solenoid changes the unusable paper sorting gate 7 to the passing state, so that the securities Pn–x to be passed through the unusable paper sorting gate 7 are guided to the cutting device or the complete paper collecting section. A branching state gate driving signal GDzt, which is supplied from the transferring sort controlling section, to be described later, is inputted, whereby the second solenoid changes the unusable paper sorting gate 7 to the branching state, so that the securities Pn–x to be passed through the unusable paper sorting gate 7 are guided to the unusable paper collecting section 8.

The securities Pn–x, that is, non-unusable papers, which are guided to the cutting device or the complete paper collecting section (passing state), are further transferred by the transfer path 5, and separated into complete papers Pt and dirty papers Pe by the operation of dirty paper sorting gate 9 based on the identification results stored in the memory (not shown), that is, identification code Pe or Pt provided to correspond to the transferring order. Before the first through sixth detecting sections 6*a* to 6*f* determine the detection results, the dirty paper sorting gate 9 is formed such that all papers are guided to the complete paper collecting section 112 or the dirty paper collecting section 116, to be described later, when the paper processing apparatus is non-operational or in an abnormal operational state (that is, when no control is provided from the outer unit).

The dirty paper sorting gate 9 has third and fourth solenoids, to be described later. The dirty paper sorting gate 9 is formed to provide two states, a securities Pn–x passing state in which securities Pn–x are guided to the complete paper collecting section or the dirty paper collecting section, and a securities Pn–x changing (branching) state in which securities Pn–x are guided to the cutting device. A passing state gate driving signal GDes, which is supplied from the transferring sort controlling section 131, to be described later, is inputted, whereby the third solenoid changes the dirty paper sorting gate 9 to the passing state, so that the securities Pn–x to be passed through the dirty paper sorting gate 9 are guided to the complete paper collecting section or the dirty paper collecting section. A branching state gate driving signal GDet, which is supplied from the transferring sort controlling section 131, to be described later, is inputted, whereby the fourth solenoid changes the dirty paper sorting gate 9 to the branching state, so that the securities Pn–x to be passed through the dirty paper sorting gate 9 are guided to the cutting device 2.

The dirty papers Pe passed through the dirty paper sorting gate 9, which is changed to be in the branching state, are further transferred by the transfer path 5, and guided to the cutting device 2. The dirty papers Pe guided to the cutting device 2 are cut to have a size, which is less than a predetermined size, by the cutting device 2, discharged to the outer section of the main body 1 by cut piece discharging path 10, and contained in a cut piece collecting chamber (no reference numeral). As mentioned above, the dirty papers Pe are normally cut by the cutting device 2, however, the main body 101 of the security processing section is set to be in another mode. As a result, the dirty papers Pe pass through the dirty paper sorting gate 9 in accordance with an instruction from the control panel (not shown) to be collected in the dirty paper collecting section 116. On the other hand, complete papers Pt passed through the dirty paper sorting gate 9, which is defined to be the passing state, are further transferred by the transfer path 5. Then, the complete papers Pt are transferred to a complete paper collecting section 112 by a complete paper sorting gate 111 to be collected in the complete paper collecting section. Before the first through sixth detecting sections 6*a* to 6*f* determine the detection results, the complete paper sorting gate 111 is formed such that all papers are guided to the dirty paper collecting section 116, to be described later, when the paper processing apparatus is in a non-operational or in an abnormal operational state (that is, when no control is provided from the outer unit).

The complete paper sorting gate 111 has fifth and sixth solenoids, to be described later. The complete paper sorting gate 111 is formed to provide two states, a securities Pn–x passing state in which securities Pn–x are guided to the dirty paper collecting section 116, and a securities Pn–x changing (branching) state in which securities Pn–x are guided to the complete paper collecting section 112. A passing state gate driving signal GDts, which is supplied from the transferring sort controlling section 131, to be described later, is inputted, whereby the fifth solenoid changes the complete paper sorting gate 111 to the passing state, so that the securities Pn–x to be passed through the complete paper sorting gate 111 are guided to the dirty paper collecting section 116. A branching state gate driving signal GDtt, which is supplied from the transferring sort controlling section 131, to be described later, is inputted. Whereby, the sixth solenoid changes the complete paper sorting gate 111 to the branching state, so that the securities Pn–x to be passed through the complete paper sorting gate 111 are guided to the complete paper collecting section 112.

The complete papers collected in the complete paper collecting section 112 are guided to a complete paper bundle section 113 every predetermined number of complete papers through a counter (not shown), which is provided at a predetermined position of the complete paper collecting section 112, whereby the complete papers are bundled every predetermined number of papers.

The bundle BPa of complete papers bundled by the complete paper bundle section 113 is collected in a complete paper bundle collecting section 115*a* of a bundle collecting section 115 by a complete paper bundle transfer path 114.

As mentioned above, when the main body 101 is set to be in another mode, when the dirty papers Pe are held as a bundle PGb of dirty papers Pe without being guided to the cutting device 2, the securities Pn–x transferred through the transfer path 5 are separated into complete papers Pt and the dirty papers Pe by the operation of the complete paper sorting gate 111, which is provided between the complete paper collecting section 112 and the dirty paper sorting gate 9, based on the identification code Pe or Pt provided to correspond to the transferring order. In this case, the dirty papers Pe are further transferred by the transfer path 5, and collected in the dirty paper collecting section 116.

The dirty papers collected in the dirty paper collecting section 116 are guided to dirty paper bundle section 117 every predetermined number of the dirty papers through a counter (not shown), which is provided at a predetermined position of the dirty paper collecting section 16, whereby the dirty papers are bundled every predetermined number of papers.

The bundle BPb of dirty papers bundled by the dirty paper bundle section 117 is transferred to the bundle collecting section 115 through a dirty paper transfer path 118 and the complete paper bundle transfer path 114, and collected in a dirty paper bundle collecting section 115*b* of the bundle collecting section 115.

At a predetermined position of the transfer path 5 of the main body 101, a plurality of shift sensors S1 to S11 are provided to detect the flow of the securities Pn–x, which are guided from the supply section 3 to the cutting device 2, the unusable paper collecting section 8, the complete paper collecting section 112, and the unusable collecting section 116, or a paper jam of the securities Pn–x in the transfer path 5. Needless to say, the state of the securities Pn–x transferred to the transfer path 5 of the main body 101 are checked by the controlling section, to be described later.

Figure 4:
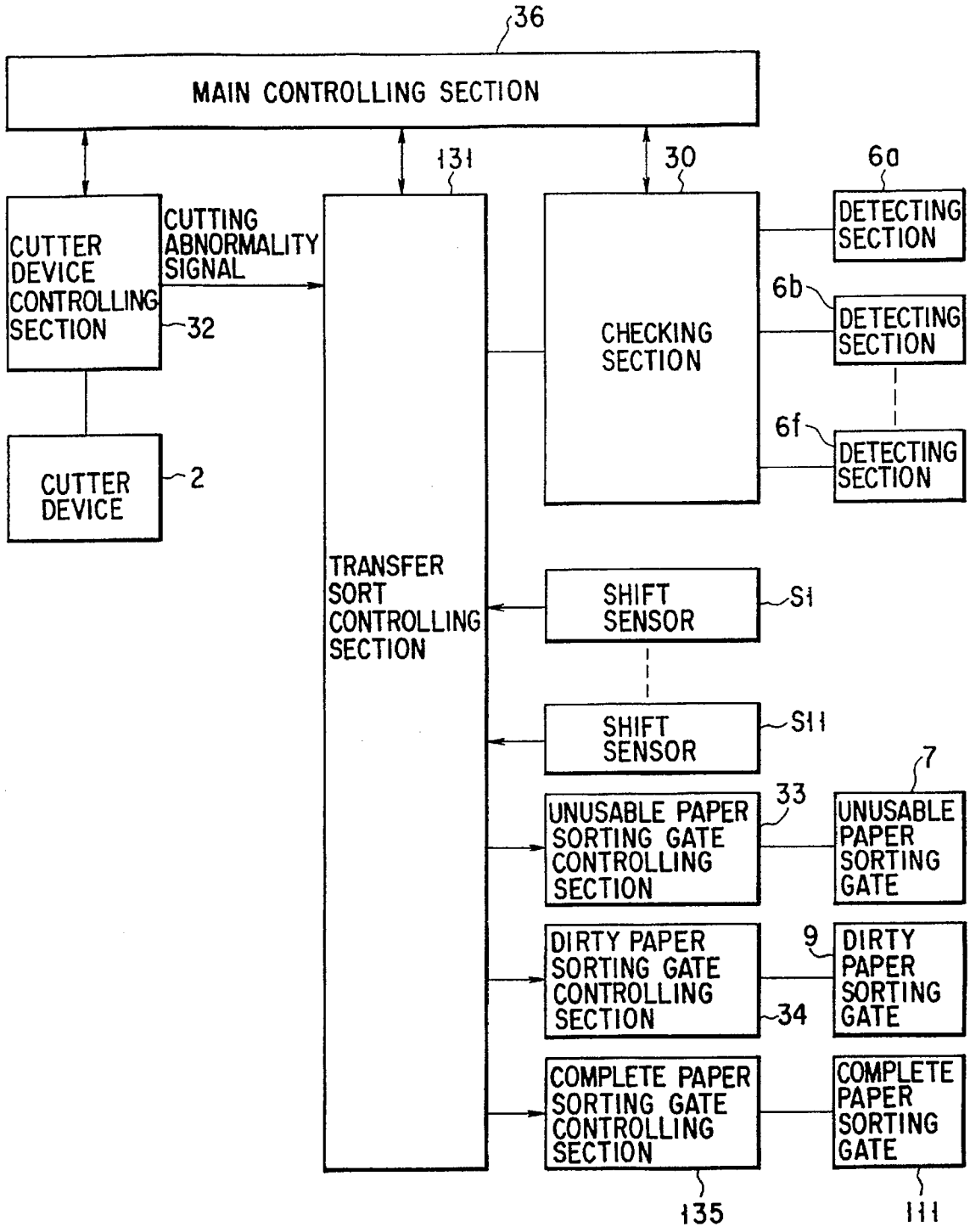
FIG. 4 is a schematic block diagram of the paper processing apparatus of FIG. 3.

FIG. 4 is a schematic block diagram showing the state of the electrical connection of the apparatus for processing the securities of FIG. 3.

With reference to FIG. 4, the detection result obtained from the first through sixth detectors 6*a* to 6*f*, which are arranged along the transfer path 5, is inputted to a checking section 30 in the order in which the securities Pn–x are transferred.

The checking section 30 classifies the securities Pn–x, which are being transferred in the transfer path 5, into complete papers Pt, dirty papers Pe, or unusable papers Pz based on the result obtained from the first through sixth detectors 6*a* to 6*f*. The checking results are temporarily stored in the memory (not shown) through the main controlling section 36, to be described later, as identification codes corresponding to the transferring order, that is, the complete paper signal SPt, the dirty paper signal SPe, and the unusable paper signal SPz, and inputted to a transfer sort controlling section 131.

The position of the securities Pn–x transferred in the main body 101 by the transfer path 5 is checked by inputting a present signal Sp as passage confirming data outputted from each of the shift sensors S1 to S11 into the transfer sort controlling section 131. Since the securities Pn–x are transferred one by one in order, the main controlling section checks which papers correspond to the present signal Sp sent from each of the sensors S1 to S11.

A cutting device controlling section 32 is connected to the transfer sort controlling section 131. The cutting device controlling section 32 controls the drive/stop of the cutting device, and counts the number of papers cut by the cutting device 2.

The cutting device controlling section 32 monitors the load state (particularly, overload level) applied to the blade of the cutting unit of the cutting device 2 and the abnormalities of the cutting device 2 such as the paper jam of securities Pn–x, which occurs just before the blade of the cutting device. If the generation of the overload or the paper jam of securities Pn–x is detected, a cutting abnormality signal SHRe is outputted to the transfer sort controlling section 131.

Moreover, the unusable paper sorting gate 7, the dirty paper sorting gate 9, and the complete paper sorting gate 111 are connected to the transfer sort controlling section 131 to be independently driven through an unusuable paper sorting gate controlling section 33, through a dirty paper sorting gate section 34 and through a complete paper sorting gate control section 135, respectively.

The transfer sort controlling section 131 guides the securities Pn–x being transferred in the transfer path 5 to either the unusable paper collecting section 8 and the cutting device 2 or the dirty paper collecting section 116 and the complete paper collecting section 112 based on the present signals Sp sent from the shift sensors S1 to S11 provided at predetermined positions of the main body 101, and the identification codes. The identification codes are the unusable paper signal SPz, the dirty paper signal SPe, and the complete paper signal SPt corresponding to the transfer order stored in the memory (not shown) by the sorting of the checking section 30 based on the detection results of the first through sixth detecting sections 6*a* to 6*f*.

Moreover, if an abnormality occurs such as an overload of the blade of the cutter unit of the cutting device or a paper jam of securities Pn–x just before the blade of the cutter unit of the cutting device, the cutting device controlling section 32 generates a cutting device abnormal signal SHRe to the transfer sort controlling section 131 which outputs a sorting gate abnormality processing change signal Ge (gate driving signals CDzt, GDes, and GDts are generically named). Before the first through sixth detecting sections 6*a* to 6*f* determine the detection results, the sorting gate abnormality processing change signal Ge is used to change the sorting gates 7, 9, and 111 corresponding to the respective gate controlling sections to the predetermined sides in order that the securities Pn–x being transferred in the transfer path 5 are not guided to the cutting device 2 through an unusable paper sorting gate controlling section 33, a dirty paper sorting gate controlling section 34, and a complete paper sorting gate controlling section 135.

Regarding the sides (directions) to which the sorting gates 7, 9, and 111 are changed by the sorting gate abnormality processing change signal Ge, the sorting gate 7 is defined as the changing (branching) side, and the sorting gates 9 and 111 are defined as the passing state sides.

The following will specifically explain the classification of the securities Pn–x transferred in the main body 101, the operation of each of the sorting gates 7, 9, and 111, and the transferring direction (flow) of the securities Pn–x.

When the security (paper) Pn–x being transferred in the transfer path is an unusable paper Pz, an unusable paper sorting gate drive timing signal GTz is outputted from the transfer sort controlling section 131 to the unusable paper sorting gate controlling section 33 at the time when the top end of the security Pn–x (Pz) is passed through the shift sensor S3. The unusable paper sorting gate drive timing signal GTz is outputted thereto so as to switch the unusable paper sorting gate 7 to the unusable paper collecting section 8 based on the identification code SPz corresponding to the transfer order read from the memory (not shown) through the main controlling section 36. The unusable paper sorting gate drive timing signal GTz is inputted to the unusable paper sorting gate controlling section 33, whereby an unusable paper sorting gate drive signal GDzt is supplied to the unusable paper sorting gate 7 by the unusable paper sorting gate controlling section 33, the unusable paper sorting gate 7 is switched to the unusable paper collecting section 8, and the transfer path 5 is changed to direct paper to the unusable paper collecting section 8. Needless to say, the unusable paper sorting gate controlling section 33 outputs the unusable paper sorting gate drive signal GDzt or GDzs based on the various signals supplied from the transfer sort controlling section 131 such as a transfer abnormality signal COVe, the cutting abnormality signal SHRe, the unusable paper signal SPz, the dirty paper signal SPe, the complete paper signal SPt, and the unusable paper sorting gate drive timing signal GTz.

If the security (paper) Pn–x being transferred in the transfer path 5 is dirty paper Pe and cutting processing using the cutting device 2 is required from the control panel (not shown), the top end of the security Pn–x (Pe) is passed through the shift sensor S6, so that a dirty paper sorting gate drive timing signal GTe is outputted from the transfer sort controlling section 131 to the dirty paper sorting gate controlling section 34 to switch the dirty paper sorting gate 9 to be the side of the cutting device 2. Based on the dirty paper sorting gate drive timing signal GTe, the dirty paper sorting gate drive signal GDet is supplied to the dirty paper sorting gate 9 by the dirty paper sorting gate controlling section 34, whereby the dirty paper sorting gate 9 is switched to be the side of the cutting device 2, and the dirty papers Pe are transferred to the cutting device 2. The number of dirty papers Pe transferred to the cutting device 2 is correctly counted by the counter (not shown), cut to have a size which is less than the predetermined size, and discharged to the outer section of the main body 1 by the cut piece discharge path 10. The dirty paper sorting gate controlling section 34 outputs the dirty paper sorting gate drive signal GDes or GDet based on the various signals supplied from the transfer sort controlling section 131 such as the transfer abnormality signal COVe (to be described later), the cutting abnormality signal SHRe, the unusable paper signal SPz, the dirty paper signal SPe, the complete paper signal SPt, and the unusable paper sorting gate drive timing signal GTz.

When the main body 101 is set to be in another mode, the cutting of dirty papers Pe is stopped, that is, the dirty papers Pe are to be collected in the dirty papers collecting section 116, the dirty paper sorting gate is maintained to be in the passing state since the dirty paper sorting gate drive signal GDet is not inputted. Therefore, the dirty papers Pe are guided to the complete sorting gate 111.

The top end of the dirty papers Pe is passed through the shift sensor S6, so that a complete paper sorting gate drive timing signal GTt is outputted from the transfer sort controlling section 131 to the complete paper sorting gate controlling section 135 to switch the complete paper sorting gate 111 toward the dirty paper collecting section 116 based on the identification code SPe corresponding to the transfer order read from the memory (not shown) through the main controlling section 36.

The complete paper sorting gate drive timing signal GTt is inputted to the complete paper sorting gate controlling section 135, so that a complete paper sorting gate drive signal GDts is supplied to the complete paper sorting gate 111 by the complete paper sorting gate controlling section 135, whereby the complete paper sorting gate 111 is switched toward the dirty paper collecting section 116, and the transfer path 5 is directed toward the dirty paper collecting section 116. As a result, the dirty papers Pe are collected in the dirty paper collecting section 116. In this case, the number of dirty papers Pe collected in the dirty paper collecting section 116 is correctly counted by the counter (not shown) provided in the vicinity of the dirty paper collecting section 116.

When the security (paper) Pn–x being transferred is complete paper Pt, the unusable paper sorting gate 7 and the dirty paper sorting gate 9 are respectively switched to the passing state, and the security Pn–x (Pt) is guided to the shift sensor S8. The above switch was performed by the control of the unusable paper sorting gate controlling section 33 and that of the dirty paper sorting gate controlling section 34 based on the identification code corresponding to the transfer order read from the memory (not shown) through the main controlling section 36.

The top end of the complete papers Pt is passed through the shift sensor S8, so that the complete paper sorting gate 111 is switched to the branching state by the control of the complete paper sorting gate controlling section 135, and the complete papers Pt are guided to the complete paper collecting section 112. The complete paper sorting gate controlling section 135 outputs a complete paper sorting gate drive signal GDt or GDtt based on the various signals supplied from the transfer sort controlling section 131 such as COVe, SHRe, SPz, SPe, SPt, and GTt.

When a paper jam of at least one security Pn–x occurs in the transfer path 5, the transfer abnormality signal COVe, which indicates the occurrence of a paper jam in the transfer path 5, is outputted from one of any of the shift sensors S1 to S11 or a plurality of shift sensors, whereby each driving section of the transfer section 5 is stopped. However, each driving section can not be stopped instantaneously. Due to this, when the transfer abnormality signal COVe is outputted, the transfer sort controlling section 131 outputs the sorting gate abnormality processing change signal Ge, which is used to switch each of the sorting gates 7, 9, and 111 to the predetermined side, to the sorting gate controlling sections 33, 34 and 135, which are used to drive the respective sorting gates, whereby gate driving signals GDzt, GDes, and GDts, which are used to instruct the predetermined gate switching direction, are outputted to the corresponding sorting gates from the sorting gate controlling sections 33, 34 and 135. As a result, the unusable paper sorting gate 7 is positioned to the branching state in which the transfer path 5 is on the side of the unusable paper collecting section 8, the sorting gate 9 is positioned to the passing state in which the transfer path 5 is on the side of the complete paper collecting section 112, and the sorting gate 111 is positioned to the passing state in which the transfer path 5 is on the side of the dirty paper collecting section 116.

Before the first through sixth detecting sections 6*a* to 6*f* determine the detection results, even if the transfer path 5 of the main body 101 is stopped, only the complete papers Pt sorted by sorting gate 111 are collected in the complete paper collecting section 112. Also, dirty papers Pe, which are positioned in the transfer path 5 up to the sorting gate 7, unusable papers Pz, and securities Pn–x–1, Pn–x, Pn–x+1 of all complete papers Pt are collected in the unusable paper collecting section 8. Moreover, dirty papers Pe, which are positioned in the transfer path 5 between sorting gates 111 and 7, and the securities Pn–x–1, Pn–x, Pn–x+1 of all complete papers Pt are collected in the dirty paper collecting section 116.

Therefore, in order to remove the securities Pn–x stopped in the middle of the transfer path 5 due to the cutting abnormality and return to processing, the securities Pn–x stopped in the middle of the transfer path 5 and the securities Pn–x collected in the unusable paper collecting section 8 or the dirty paper collecting section 116 may be visually checked, or returned to the supply section 3, whereby until the transfer path 5 is completely stopped, the securities Pn–x to be transferred can be prevented from being erroneously transferred to the cutting device 2 and the securities Pn–x can be prevented from being guided to the complete collecting section 112.

The following will explain an abnormality of the cutting device 2 such as the overload state of the cutting device 2, the paper jam of securities Pn–x just before the blade of the cutter unit, and the processing for the abnormality.

When the dirty paper sorting gate 9 is positioned to the branching state (changing state) and dirty papers Pe are transferred to the cutting device 2, for example, the cutter unit (not shown) of the cutting device 2 is in the overload state, the cutting abnormality signal SHRe is outputted to the transfer sort controlling section 131 from the cutting device controlling section 32 which drives the cutting device 2, whereby each driving section of the transfer section 5 is stopped. However, each driving section can not be stopped instantaneously. Due to this, when the cutting abnormality signal SHRe is outputted, before the first through sixth detecting sections 6*a* to 6*f* determine the detection results, the transfer sort controlling section 131 outputs the sorting gate abnormality processing change signal Ge, which is used to switch each of the sorting gates 7, 9, and 111 to the predetermined side, to the sorting gate controlling sections 33, 34 and 135, which are used to drive the respective sorting gates, whereby gate driving signals GDzt, GDes, and GDts, which are used to instruct the predetermined gate switching direction, are outputted to the corresponding sorting gates from the sorting gate controlling sections 33, 34 and 135. Consequently, before the first through sixth detecting sections 6*a* to 6*f* determine the detection results, the unusable paper sorting gate 7 is positioned to the branching state in which the transfer path 5 is on the side of the unusable paper collecting section 8, the sorting gate 9 is positioned to the passing state in which the transfer path 5 is on the side of the complete paper collecting section 112, and the sorting gate 111 is positioned to the passing state in which the transfer path 5 is on the side of the dirty paper collecting section 116.

Therefore, even if the transfer path 5 of the main body 101 is stopped, only complete papers Pt sorted by the sorting gate 111 are collected in the complete paper collecting section 112. Also, dirty papers Pe, which are positioned in the transfer path 5 up to the sorting gate 7, unusable papers Pz, and securities Pn–x–1, Pn–x, Pn–x+1 of all complete papers Pt are collected in the unusable paper collecting section 8. Moreover, dirty papers Pe, which are positioned in the transfer path 5 between the sorting gates 111 and 7, and the securities Pn–x–1, Pn–x, Pn–x+1 of all complete papers Pt are collected in the dirty paper collecting section 116.

Therefore, in order to remove the securities Pn–x stopped in the middle of the transfer path 5 due to the cutting abnormality and restore processing, the securities Pn–x stopped in the middle of the transfer path 5 and the securities Pn–x collected in the unusable paper collecting section 8 or the dirty paper collecting section 116 may be visually checked, or they may be returned to the supply section 3, whereby until the transfer path 5 is completely stopped, securities Pn–x to be transferred can be prevented from being erroneously transferred to the cutting device 2 and the securities Pn–x can be prevented from being guided to the complete paper collecting section 112 before being classified.

Figure 5:
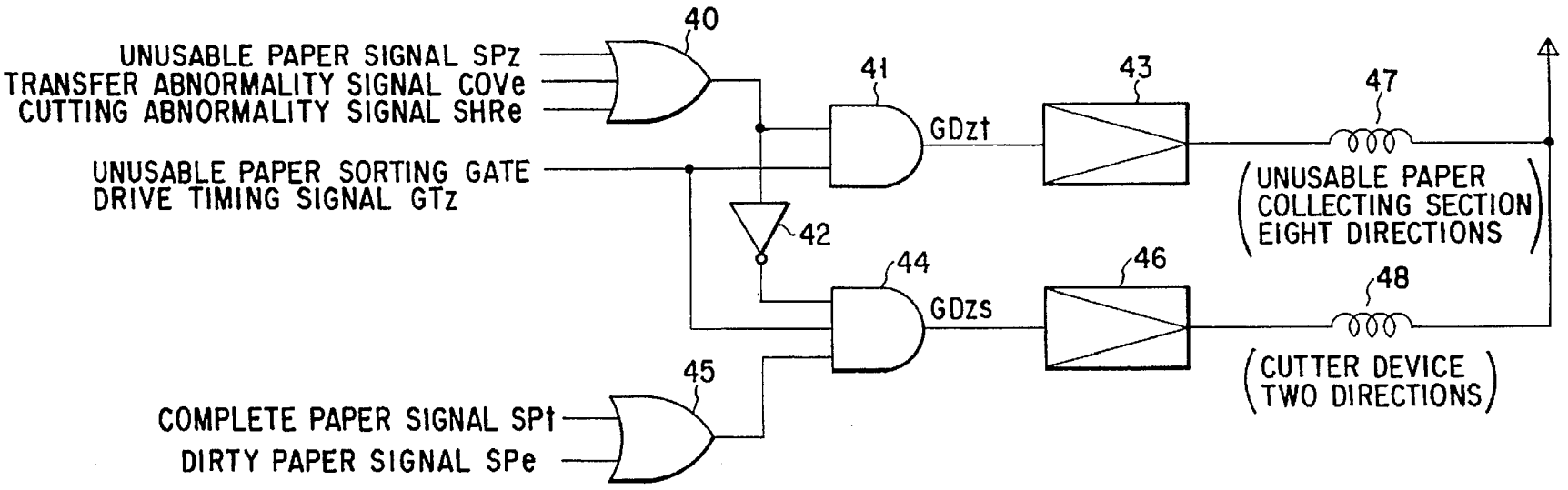
FIG. 5 is a schematic circuit diagram showing one example of an unusable paper sorting gate controlling section of the paper processing apparatus of FIGS. 1 and 3.
Figure 6:
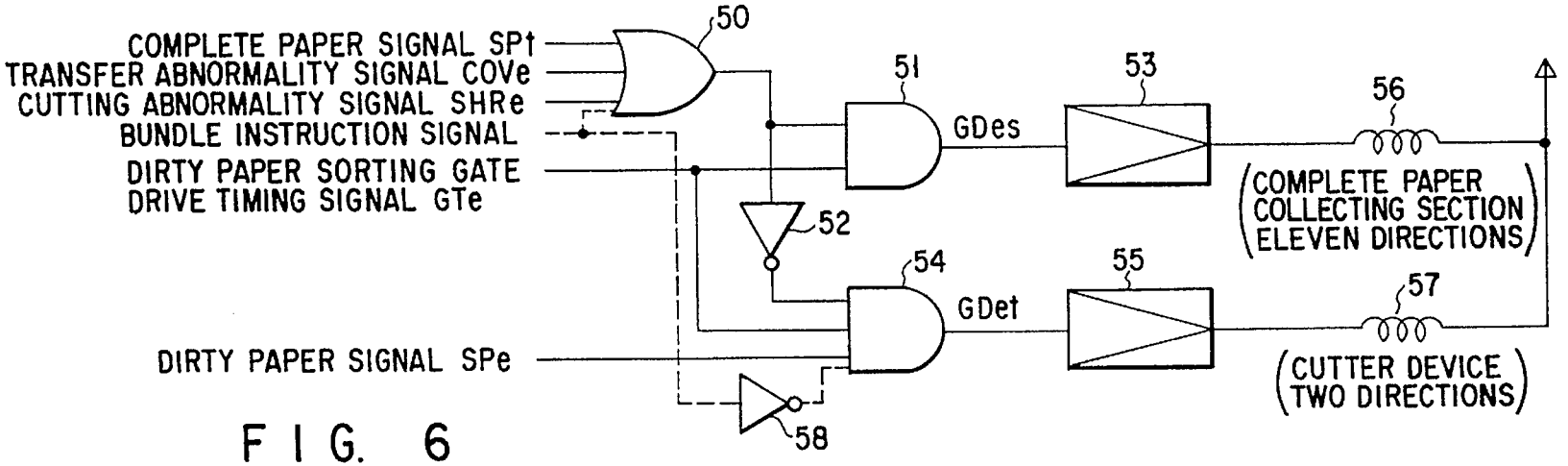
FIG. 6 is a schematic circuit diagram showing one example of a dirty paper sorting gate controlling section of the paper processing apparatus of FIGS. 1 and 3.
Figure 7:
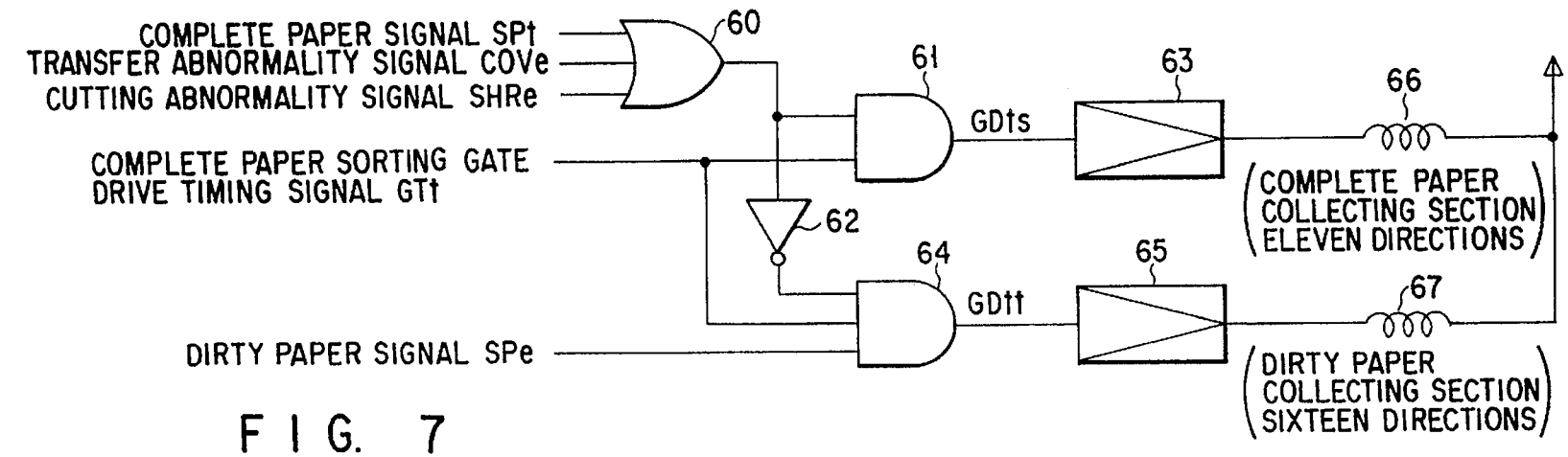
FIG. 7 is a schematic circuit diagram showing one example of a complete paper sorting gate controlling section of the paper processing apparatus of FIG. 3.

The following will explain the specific examples of control circuits, which are suitable for operating gates 7, 9, and 111, the dirty paper sorting gate controlling section 34, and for operating gate 9 and the complete paper sorting gate controlling section 135, with reference to FIGS. 5, 6 and 7, respectively.

FIG. 5 shows a specific example of the unusable paper sorting gate controlling section.

In FIG. 5, the unusable paper signal SPz, the transfer abnormality signal COVe and the cutting abnormality signal SHRe are inputted to an OR gate 40 from the transfer sort controlling section 131 (31). An OR output of each of the input signals of the OR gate 40 is inputted to an AND gate 41 and an inverter 42. The unusable paper sorting gate drive timing signal GTz is inputted to the AND gate 41 from the transfer sort controlling section 131 (31). In addition the OR output of the OR gate 40 is inputted to AND gate 41. An AND output of the AND gate 41 is inputted to an unusable paper sorting gate driving section 43.

As is obvious from FIG. 5, a fetching section for fetching each unusable paper signal SPz, transfer abnormality signal COVe and cutting abnormality signal SHRe, is formed based on a positive logic. When one of any of the unusable paper signal SPz, the transfer abnormality signal COVe and the cutting abnormality signal SHRe is inputted to the OR gate 40 in a high level (0→1), and synchronized with the unusable paper sorting gate drive timing signal GTz, the unusable paper sorting gate drive signal GDzt is outputted to the unusable paper sorting gate driving section 43. The unusable paper sorting gate driving section 43 is a circuit for supplying an exciting current, which excites a first solenoid 47 for changing the unusable paper sorting gate 7 to the side of the unusable paper collecting section 8. The unusable paper sorting gate 7 is changed to the side of the unusable paper collecting section 8 when the unusable paper sorting gate drive signal GDzt is generated, whereby the securities Pn–x being transferred to the unusable paper sorting gate 7 are guided to the unusable paper collecting section 8.

On the other hand, the input of the NOT gate 42 is inputted to an AND gate 44. An OR output is inputted to the AND gate 44 by an OR gate 45 which outputs the OR output of the complete paper signal SPt and the dirty paper signal SPe. Moreover, the unusable paper sorting gate drive timing signal GTz is inputted to the AND gate 44.

As is obvious from FIG. 5, a fetching section for fetching each complete paper signal SPt and dirty paper signal SPe is formed based on a positive logic. One of the complete paper signal SPt, and the dirty paper signal SPe is inputted to the OR gate 45 in a high level (0→1). When the output (=1) of the inverter 42 and one of the signals SPt and the signal SPe are inputted to the AND gate 44, they are synchronized with the unusable paper sorting gate drive timing signal GTz, and the unusable paper sorting gate drive signal GDzs is outputted to the unusable paper sorting gate driving section 46. The unusable paper sorting gate driving section 46 is a circuit for supplying an exciting current, which excites a second solenoid 48 for changing the unusable paper sorting gate 7 to the side of the cutting device 2. The unusable paper sorting gate 7 is changed to the side of the cutting device 2 when the unusable paper sorting gate drive signal GDzs is generated. Whereby, the securities Pn–x (Pz) being transferred to the unusable paper sorting gate 7 are guided toward the cutting device 2.

In other words, if the security Pn–x, which is to be sorted by the unusable paper sorting gate 7, is unusable paper Pz, the solenoid 47 is driven by the input of the unusable paper signal SPz to the OR gate 40, the unusable paper sorting gate 7 is changed to the branching state, and the security Pn–x is guided to the unusable paper collecting section 8. On the other hand, if the security Pn–x, which is to be sorted by the unusable paper sorting gate 7, is complete paper Pt or dirty paper, the solenoid 48 is driven by the input of the complete paper signal SPt or the dirty paper signal SPe to the OR gate 45, the passage of the unusable paper sorting gate 7 is maintained, and security Pn–x is guided toward the complete paper collecting section 112 or the cutting device 2.

When the transfer abnormality or the cutting abnormality is generated, the solenoid 47 is driven by the input of the transfer abnormality signal COVe or the cutting abnormality signal SHRe to the OR gate 40, and the unusable paper sorting gate 7 is changed to the branching state regardless of the kind of securities Pn–x (identification codes) to be sorted by the unusable paper sorting gate 7. As a result, the securities Pn–x are guided to the unusable paper collecting section 8. When the transfer abnormality or the cutting abnormality is generated, the securities Pn–x, which already passed through the unusable paper sorting gate 7, are guided toward the dirty paper collecting section 116 by the dirty paper sorting gate 9 or the complete paper sorting gate 111.

FIG. 6 shows a specific example of the dirty paper sorting gate controlling section.

In FIG. 6, the complete paper signal SPt, the transfer abnormality signal COVe, and the cutting abnormality signal SHRe are inputted to an OR gate 50 from the transfer sort controlling section 131 (31).

OR outputs of the OR gate 50 are inputted to an AND gate 51 and an inverter 52, respectively. In addition to the OR output of the OR gate 50, the dirty paper sorting gate drive timing signal GTe is inputted to the AND gate 51 from the transfer sort controlling section 131 (31). An AND output of the AND gate 51 is inputted to a dirty paper sorting gate driving section 53.

As is obvious from FIG. 6, a fetching section for fetching each of the complete paper signal SPt the transfer abnormality signal COVe, and the cutting abnormality signal SHRe is formed based on a positive logic. One of the complete paper signal SPt, the transfer abnormality signal COVe, end the cutting abnormality signal SHRe is inputted to the OR gate 50 in a high level (0→1), and synchronized with the dirty paper sorting gate drive timing signal GTe, so that the dirty paper sorting gate drive signal GDes is outputted to the dirty paper sorting gate driving section 53. The dirty paper sorting gate driving section 53 is a circuit for supplying an exciting current, which excites a third solenoid 56 for changing the dirty paper sorting gate 9 to the side of the dirty paper collecting section 116 (complete paper collecting section 112). The dirty paper sorting gate 9 is changed to the side of the complete paper collecting section 112 (dirty paper collecting section 116) when the gate drive signal GDes is generated, whereby the securities Pn–x being transferred to the dirty paper sorting gate 9 are guided to the dirty paper collecting section 116 (complete paper collecting section 112). When non-cut dirty papers are to be bundled, the bundling of the dirty papers Pe by the dirty paper bundle section 117 is instructed by the control panel. A bundle instruction signal (shown by a dotted line of FIG. 6) is supplied to the OR gate 50. Therefore, the dirty papers Pe are passed in a passing state.

On the other hand, the output of the inverter 52 is inputted to an AND gate 54. Also, the dirty paper signal SPe is inputted to the AND gate 54. Moreover, the dirty paper sorting gate drive timing signal GTe is inputted to the AND gate 54.

As is obvious from FIG. 6, a fetching section for fetching the dirty paper signal SPe is formed based on a positive logic, and the dirty paper signal SPe is inputted to the AND gate 54 in a high level (0→1). Moreover, when the output (=1) of the inverter 52 is inputted to the AND gate 54, the signal SPe and the output of the inverter 52 are synchronized with the dirty paper sorting gate drive timing signal GTe, and the dirty paper sorting gate drive signal GDet is outputted to a dirty paper sorting gate driving section 55. The dirty paper sorting gate driving section 55 is a circuit for supplying an exciting current, which excites a fourth solenoid 57 for changing the dirty paper sorting gate 9 to the side of the cutting device 2. The dirty paper sorting gate 9 is changed to the side of the cutting device 2 when the gate drive signal GDet is generated, whereby the securities Pn–x (Pz) being transferred to the dirty paper sorting gate 9 are guided to the cutting device 2.

When non-cut dirty papers are to be bundled, the bundling of dirty papers Pe by the dirty paper bundle section 117 is instructed by the control panel. A bundle instruction signal and an inverse signal of the bundle instruction signal (provided by inverter 58) is supplied to the OR gate 50 and the AND gate 54, respectively. Due to the bundle instruction signal, the flow of the signal through the AND gate 54 is substantially canceled. Therefore, the dirty papers Pe are passed in a passing state.

As mentioned above, when the securities Pn–x to be sorted by dirty paper sorting gate 9 are dirty papers Pe, the instruction to cut is inputted by the control panel and the solenoid 57 is driven by the input of the dirty paper signal SPe and the inverse signal of the bundle instruction signal to the AND gate 54, so that the dirty paper sorting gate is changed to the branching state, and the securities Pn–x are guided to the cutter device 2.

On the other hand, if the securities Pn–x, which are to be sorted by the dirty paper sorting gate 9, are complete papers Pt or non-cutting is instructed, the solenoid 56 is driven by the input of the complete paper signal SPt to the OR gate 50, the passage of the dirty paper sorting gate 9 is maintained, and the complete papers Pt are guided to the complete paper collecting section 112 or the dirty paper collecting section 116.

When the transfer abnormality or the cutting abnormality is generated, the solenoid 56 is driven by the input of the transfer abnormality signal COVe or that of the cutting abnormality signal SHRe to the OR gate 50, and the dirty paper sorting gate 9 is returned to the passing state regardless of the kind of securities Pn–x (identification codes) to be sorted by the dirty paper sorting gate 9. As a result, all securities Pn–x–1, Pn–x, Pn–x+1 . . . are guided to the unusable paper collecting section 8. When the transfer abnormality or the cutting abnormality is generated, the securities Pn–x, which are already passed through the unusable paper sorting gate 7, are guided to the complete paper collecting section 112 or the dirty paper collecting section 116. The securities Pn–x, which already passed through the dirty paper sorting gate 9, are guided to the dirty paper collecting section 116 by the complete paper sorting gate 111.

FIG. 7 shows a specific example of the complete sorting gate controlling section.

In FIG. 7, the complete paper signal SPt, the transfer abnormality signal COVe, and the cutting abnormality signal SHRe are inputted to an OR gate 60 from the transfer sort controlling section 131 (31).

OR outputs of the OR gate 60 are inputted to an AND gate 61 and inverter 62, respectively. In addition to the OR output of the OR gate 60, the complete paper sorting gate drive timing signal GTt is inputted to the AND gate 61 from the transfer sort controlling section 131 (31). An AND output of the AND gate 61 is inputted to a complete paper sorting gate driving section 63.

As is obvious from FIG. 7, a fetching section for fetching each complete paper signal SPt of the complete sorting gate controlling section 135, the transfer abnormality signal COVe, and the cutting abnormality signal SHRe is formed based on a positive logic. One of the complete paper signal SPt, the transfer abnormality signal COVe, and the cutting abnormality signal SHRe is inputted to the OR gate 60 in a high level (0→1), and synchronized with the complete paper sorting gate drive timing signal GTt, so that the complete paper sorting gate drive signal GDts is outputted to a complete paper sorting gate driving section 63. The complete paper sorting gate driving section 63 is a circuit for supplying an exciting current, which excites a fifth solenoid 66 for changing the complete paper sorting gate 111 to the side of the complete paper collecting section 112. The complete paper sorting gate 111 is changed to the side of the complete paper collecting section 112 when the gate drive signal GDts is generated. Whereby, the securities Pn–x being transferred to the complete paper sorting gate 111 are guided to the complete paper collecting section 112.

On the other hand, the input of inverter 62 is inputted to an AND gate 64. Also, the dirty paper signal SPe is inputted to the AND gate 64. Moreover, the complete paper sorting gate drive timing signal GTt is inputted to the AND gate 64. Needless to say, all inputs of OR gate 60 are "0" when the output of the AND gate 64 becomes "1".

When the output of the AND gate 64 becomes "1", the complete paper sorting gate driving section 65 is driven to supply an exciting current, which excites a sixth solenoid 67 for changing the complete paper sorting gate 111 to the side of the dirty paper collecting section 116.

It is obvious from FIG. 7 and the explanation given so far, that the complete paper sorting gate 111 is changed to the side of the complete paper collecting section 112 when the securities Pn–x being transferred to the complete paper sorting gate 111 are checked as complete papers Pt.

When the non-cut dirty papers Pe are to be bundled, the bundling of dirty papers Pe by the dirty paper bundle section 117 is instructed by the control panel. A bundle instruction signal and an inverse signal of the bundle instruction signal (provided by inverter 58) is supplied to the OR gate 50 and the AND gate 54, respectively. Due to this, the flow of the signal through the AND gate 64 is substantially canceled. Therefore, dirty papers Pe, which are not guided to the cutting device 2, are passed in a passing state.

As mentioned above, when the securities Pn–x to be sorted by the complete paper sorting gate 111 are complete papers Pt, the cutting instruction is inputted by the control panel, and the solenoid 66 is driven by the input of the complete paper signal SPt to the AND gate 61, so that the complete paper sorting gate 111 is changed to the branching state, and the securities Pn–x are guided to the complete paper collecting section 112. On the other hand, when the securities Pn–x are dirty papers Pe and non-cutting is instructed by the control panel, the solenoid 67 is driven by the input of the dirty paper signal SPe to the AND gate 64, so that the passage of the complete paper sorting gate 111 is maintained, and the securities Pn–x are guided to the dirty paper collecting section 116.

Also, when a transfer abnormality or a cutting abnormality is generated, the solenoid 66 is driven by the input of the transfer abnormality signal COVe or that of the cutting abnormality signal SHRe to the OR gate 60, so that the complete paper sorting gate 111 is returned to the passing state regardless of the kind of the securities Pn–x to be sorted by the complete paper sorting gate 111. As a result, all securities Pn–x–1, Pn–x, Pn–x+1 . . . are guided to the complete paper collecting section 112.

Needless to say the securities Pn–x which already passed through the complete paper sorting gate 111, are guided to the complete paper collecting section 112.

By using the unusable paper sorting gate controlling section of FIG. 5, the dirty paper sorting controlling section of FIG. 6, and the complete paper sorting controlling section of FIG. 7, before the first to sixth detecting sections 6*a* to 6*f* determine the detection result, a transfer abnormality of the main body 101 or of the cutting device 2 detected while the securities Pn–x are being transferred in the transfer path 5 causes the securities Pn–x being transferred between the unusable paper sorting gate 7 and the supply section 3 to be collected in the unusable paper collecting section 8, and the securities Pn–x already transferred through the unusable paper sorting gate 7, to be guided to the complete paper collecting section 112.

Figure 8:
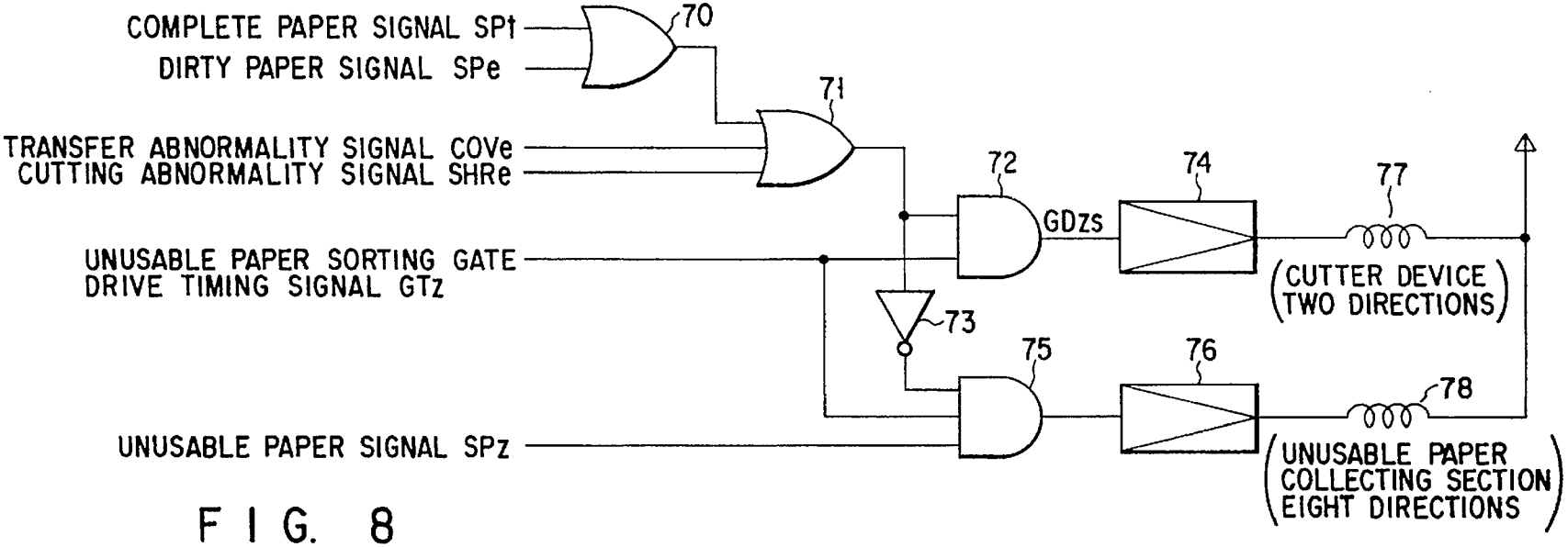
FIG. 8 is a schematic circuit diagram showing a modification of the unusable paper sorting gate of FIG. 5.
Figure 9:
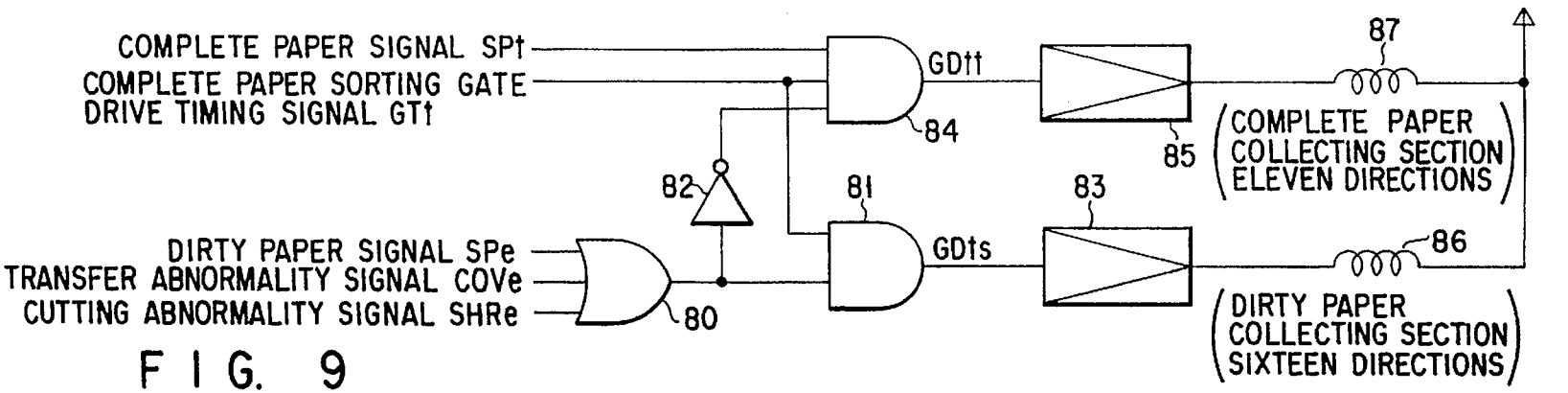
FIG. 9 is a schematic circuit diagram showing a modification of the complete paper sorting gate of FIG. 7.

The following will explain other specific examples of the control circuits, which are suitable for the unusable paper sorting gate controlling section for operating the gates 7, 9, and 111, the dirty paper sorting gate controlling section, and the complete paper sorting gate controlling section, with reference to FIGS. 8 and 9, respectively.

FIG. 8 shows another embodiment of the unusable paper sorting gate controlling section of FIG. 5.

In FIG. 8, the complete paper signal SPt transmitted from the transfer sort controlling section 131 (31) and the dirty paper signal SPe are inputted to two input terminals of an OR gate 70, respectively. An OR output of the OR gate 70 is inputted to one of three input terminals of an OR gate 71.

The transfer abnormality signal COVe transmitted from the transfer sort controlling section 131 (31) is inputted to one input terminal of the residual input terminal of the OR gate 71, and the cutting abnormality signal SHRe transmitted from the transfer sort controlling section 131 (31) is inputted to the other input terminal of the residual input terminals of the OR gate 71. An OR output of the OR gate 71 is inputted to one input terminal of an AND gate 72 and an input terminal of the inverter 73.

The unusable paper sorting gate drive timing signal GTz transmitted from the transfer sort controlling section 131 (31) is inputted to the other input terminal of the AND gate 72.

When the AND output of the AND gate 72 is "1", the AND signal driven by the OR output of the OR gate 71 (OR output of all signals SPt, Spe, COVe, and SHRe) and the gate drive timing signal GTz, is inputted to an unusable paper sorting gate driving section 74 to supply an exciting current, which excites a first solenoid 77 for changing the unusable paper sorting gate 7 to the side of the dirty paper collecting section 116 (cutting device 2). In other words, at the time when one of any complete paper signal SPt, dirty paper signal SPe, transfer abnormality signal COVe, and cutting abnormality signal SHRe is in a high level (0→1), and synchronized with the unusable paper sorting gate drive timing signal GTz, the gate drive signal GDzs for changing the unusable paper sorting gate 7 to the side of the dirty paper collecting section 116 (cutting device 2) is outputted to the solenoid 77 from the unusable paper sorting gate driving section 74. Therefore, securities Pn–x except unusable papers Pz, which are to be passed through the unusable paper sorting gate 7, are guided to the dirty paper collecting section 116 by the input of either the transfer abnormality signal COVe or the cutting abnormality signal SHRe.

The output of the inverter 73 is inputted to one of three input terminals of an AND gate 75. The unusable paper sorting gate drive timing signal GTz transmitted from the transfer sort controlling section 131 (31) is inputted to one input terminal of the residual input terminals of the AND gate 75. Moreover, the unusable paper signal SPz transmitted from the transfer sort controlling section 131 (31) is inputted to another input terminal of the residual input terminals of the AND gate 75.

Only when the complete paper signal SPt, the dirty paper signal SPe, the transfer abnormality signal COVe, and the cutting abnormality signal SHRe are all "0", and the unusable paper signal SPz is "1", the AND gate 75 outputs "1". When the output of the AND gate 75 is "1", the output of the AND gate 75 is synchronized with the unusable paper sorting gate drive timing signal GTz, and the gate drive signal GDzt for changing the unusable paper sorting gate 7 to the side of the unusable paper collecting section 8 is outputted to a solenoid 78 from the unusable paper sorting gate driving section 76. As a result, the unusable paper sorting gate 7 is changed to the side of the unusable paper collecting section 8. Therefore, only when the securities Pn–x, which are to be passed through the unusable paper sorting gate 7, are unusable papers Pz, the securities Pn–x (Pz) are guided to the unusable paper collecting section 8.

When the unusable paper sort controlling section of FIG. 8 is used, all securities Pn–x including the unusable papers Pz are transferred to the dirty paper collecting section 116 side when the transfer abnormality signal COVe or the cutting abnormality signal SHRe is 0→1. Therefore, the processing operation can be easily restored by visually checking the papers, which are stopped in the middle of the transfer path, and the papers, which are collected in the unusable collecting section, or by returning these papers to the supply section.

FIG. 9 shows another embodiment of the complete paper sorting gate controlling section of FIG. 7.

In FIG. 9, the dirty paper signal SPe, the transfer abnormality signal COVe, and the cutting abnormality signal SHRe, which are transmitted from the transfer sort controlling section 131 (31), are inputted to the three input terminals of an OR gate 80, respectively. An OR output of the OR gate 80 is inputted to one of two input terminals of an AND gate 81 and an inverter 82. The complete paper sorting gate drive timing signal GTt transmitted from the transfer sort controlling section 131 (31) is inputted to the other input terminal of the AND gate 81.

When the AND output of the AND gate 81 is "1", the AND signal of the OR output of the OR gate 80 (OR output of all signals Spe, COVe, and SHRe) and the gate drive timing signal GTt are inputted to a complete paper sorting gate driving section 83 to supply an exciting current, which excites a solenoid 86 for changing the complete paper sorting gate 111 to the side of the dirty paper collecting section 116. In other words, at the time when one of any dirty paper signal SPe, transfer abnormality signal COVe, and the cutting abnormality signal SHRe is in a high level (0→1), and synchronized with the gate drive timing signal GTt, the gate drive signal GDts for changing the complete paper sorting gate 111 to the dirty paper collecting section 116 side is outputted to the solenoid 86 from the complete paper sorting gate driving section 83. As a result, the complete paper sorting gate 111 is changed to the dirty paper collecting section 116. Therefore, all securities Pn–x including the complete papers Pt, which are to be passed through the complete paper sorting gate 111, are guided to the dirty paper collecting section 116 by the input of either the transfer abnormality signal COVe or the cutting abnormality signal SHRe.

The output of inverter 82 is inputted to one of three input terminals of AND gate 84. The complete paper sorting gate drive timing signal GTt transmitted from the transfer sort controlling section 131 (31) is inputted to one input terminal of the residual input terminals of the AND gate 84. Moreover, the complete paper signal SPt transmitted from the transfer sort controlling section 131 (31) is inputted to the remaining input terminal of AND gate 84.

Only when the complete paper signal SPt is "1" and the dirty paper signal SPe, the transfer abnormality signal COVe, and the cutting abnormality signal SHRe are all "0", the AND gate 84 outputs the signal "1". When the output of the AND gate 84 is "1", the output of the AND gate 84 is synchronized with the complete paper sorting gate drive timing signal GTt, and the gate drive signal GDtt for changing the complete paper sorting gate 111 to the complete paper collecting section 112 is outputted to a solenoid 87 from the complete paper sorting gate driving section 85. As a result, the complete paper sorting gate 111 is changed to the complete paper collecting section 112. Therefore, only when the securities Pn–x, which are to be passed through the complete paper sorting gate 111, are complete papers Pt, will the securities Pn–x (Pz) be guided to the complete paper collecting section 112.

When the complete paper sort controlling section of FIG. 9 is used, all securities Pn–x including complete papers Pt are transferred to the dirty paper collecting section 116 when the transfer abnormality signal COVe or the cutting abnormality signal SHRe is 0→1 because of a transfer abnormality or cutting abnormality. Therefore, the processing operation can be easily restored by visually checking the papers which are stopped in the middle of the transfer path, and the papers which are collected in the dirty paper collecting section 116, or by returning these papers to the supply section.

As explained above, by use of the unusable paper sorting gate controlling section of FIG. 8, the dirty paper sorting gate controlling section of FIG. 6, and the complete paper sorting gate controlling section of FIG. 9, before the first to sixth detecting sections *6a* to *6f* determine the detected result, when a transfer abnormality of the main body 101 or a cutting abnormality of the cutting device 2 are detected while the securities Pn–x are being transferred in the transfer path 5, all securities Pn–x transferred from transfer path 5 will be guided to the dirty paper collecting section 116 regardless of the kind of paper.

As is obvious from the above explanation, all sorting gates provided in the transfer path of the apparatus for processing securities are changed so as to define a transfer path other than a transfer path which directs papers to the cutting device when a paper jam of securities to be processed in the transfer path occurs or the cutting device is in the overload state. Therefore, until the transfer path is completely stopped, the securities Pn–x to be transferred can be prevented from being erroneously transferred to the cutting device and securities Pn–x can be prevented from being guided to the complete collecting section.

Moreover, the sorting gates which form a transfer path other than a transfer path directing papers to the cutting device, can be defined such that all securities being transferred are guided to a collecting section other than the complete paper collecting section. Therefore, in order to restore processing, the securities Pn–x stopped in the middle of the transfer path and the securities Pn–x collected in the unusable paper collecting section or the dirty paper collecting section may be visually checked, or, may be returned to the supply section.

Moreover, since it is unnecessary to provide a sorting gate and a connecting section for abnormal processing, an increase in the size of the apparatus can be prevented, so that small-sized apparatus for processing the securities can be provided.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A paper processing apparatus comprising:

supplying means for supplying papers one by one;

first transferring means for transferring said papers supplied by said supplying means;

checking means for reading said papers transferred by said first transferring means to check whether said papers are one of complete papers, unusable papers, and dirty papers;

second transferring means connected to said first transferring means for transferring said papers checked as unusable by said checking means;

first collecting means for collecting said unusable papers transferred by said second transferring means;

first branching means for branching said unusable papers from among said papers transferred by said first transferring means to said second transferring means;

third transferring means connected to said first transferring means for transferring said papers checked as complete papers by said checking means from among said papers that are not branched to said second transferring means by said first branching means;

second collecting means for collecting said complete papers transferred by said third transferring means;

second branching means for branching said complete papers from among said papers transferred by said first transferring means to said third transferring means;

fourth transferring means connected to said first transferring means for transferring said papers checked as dirty papers by said checking means, that were not branched to said third transferring means by said second branching means;

discarding means for discarding papers transferred by said fourth transferring means;

detecting means for detecting an abnormality in said first through said fourth transferring means and said discarding means; and controlling means for controlling said first branching means to branch said complete, unusable and dirty papers to said second transferring means to allow said first collecting means to collect said complete, unusable and dirty papers and controlling said second branching means to branch said complete and dirty papers to said third transferring means to allow said second collecting means to collect said complete and dirty papers prior to obtaining a checking result from said checking means, when said abnormality is detected in at least one of said first through fourth transferring means and said discarding means by said detecting means.

2. The paper processing apparatus according to claim 1, wherein said discarding means includes a shredder for shredding papers to a size less than a predetermined size.

3. The paper processing apparatus according to claim 2, wherein said detecting means includes a sensor for detecting said abnormality caused by a paper jam in said first through fourth transferring means, and a discarding means controlling section for detecting said abnormality of said discarding means from a load applied onto said shredder.

4. The paper processing apparatus according to claim 1, further comprising:

bundling means for bundling every predetermined number of papers that have been collected by said second collecting means.

5. A paper processing apparatus comprising:

supplying means for supplying papers one by one;

first transferring means for transferring said papers supplied by said supplying means;

checking means for reading said papers transferred by said first transferring means to check whether said papers are one of complete papers, unusable papers, and dirty papers;

second transferring means connected to said first transferring means for transferring said papers checked as unusable by said checking means;

first collecting means for collecting said unusable papers transferred by said second transferring means;

first branching means for branching said unusable papers from among said papers transferred by said first transferring means to said second transferring means;

third transferring means connected to said first transferring means for transferring said papers checked as complete papers by said checking means and selectively transferring said papers checked as dirty papers by said checking means from among said papers that were not branched to said second transferring means by said first branching means;

second collecting means for collecting said complete papers transferred by said third transferring means;

third collecting means for collecting said dirty papers transferred by said third transferring means;

second branching means for selectively branching said dirty papers to said third transferring means from among said papers transferred by said first transferring means along with said complete papers;

fourth transferring means connected to said first transferring means for selectively transferring said papers checked as dirty papers by said checking means;

discarding means for discarding said papers transferred by said fourth transferring means;

detecting means for detecting an abnormality in said first to fourth transferring means and said discarding means;

designating means for selectively designating said dirty papers to be collected by said third collecting means or discarded by said discarding means; and controlling means for controlling said first branching means to branch said complete, unusable and dirty papers to said second transferring means such that said complete, unusable and dirty papers are collected by said first collecting means and said second branching means to branch said complete and dirty papers to said third transferring means such that said complete and dirty papers are collected by said third collecting means prior to obtaining a checking result from said checking means, when said abnormality in at least one of said first through fourth transferring means and said discarding means is detected by said detecting means, while said dirty papers are selected to be discarded by said designating means.

6. The paper processing apparatus according to claim 5, wherein said discarding means includes a shredder for shredding papers to a size less than a predetermined size.

7. The paper processing apparatus according to claim 6, wherein said detecting means includes a sensor for detecting said abnormality from a paper jam in said first through fourth transferring means, and a discarding means controlling section for detecting said abnormality of said discarding means from a load applied onto said shredder.

8. The paper processing apparatus according to claim 5, further comprising:

bundling means for bundling every predetermined number of papers that have been collected by said second collecting means.

* * * * *